US008732990B1

(12) United States Patent
Danreuther

(10) Patent No.: US 8,732,990 B1
(45) Date of Patent: May 27, 2014

(54) WING LOCK FOR SIDE-MOUNTED SNOW PLOW

(76) Inventor: Aaron Danreuther, Kalispell, MT (US)

( * ) Notice: Subject to any disclaimer, the term of this patent is extended or adjusted under 35 U.S.C. 154(b) by 254 days.

(21) Appl. No.: 13/447,271

(22) Filed: Apr. 15, 2012

Related U.S. Application Data

(60) Provisional application No. 61/475,964, filed on Apr. 15, 2011.

(51) Int. Cl.
*E01H 5/06* (2006.01)

(52) U.S. Cl.
USPC ..... 37/281

(58) Field of Classification Search
USPC ..... 37/231–236, 269, 266, 279–283; 172/741–743, 786, 811, 819, 815, 817
See application file for complete search history.

(56) References Cited

U.S. PATENT DOCUMENTS

| | | | | |
|---|---|---|---|---|
| 4,096,652 | A | 6/1978 | Raines et al. | |
| 4,969,280 | A * | 11/1990 | Thorneloe | 37/281 |
| 5,903,987 | A * | 5/1999 | Nuske | 37/281 |
| 6,134,814 | A | 10/2000 | Christy et al. | |
| 6,412,200 | B1 * | 7/2002 | Savard | 37/281 |
| 6,581,307 | B1 * | 6/2003 | Jones et al. | 37/281 |
| 6,711,837 | B2 | 3/2004 | Bloxdorf et al. | |
| 6,944,978 | B2 | 9/2005 | LeBlond et al. | |
| 7,107,710 | B2 * | 9/2006 | Savard | 37/274 |
| 7,430,821 | B2 | 10/2008 | LeBlond et al. | |
| 7,523,569 | B2 * | 4/2009 | Savard | 37/279 |
| 8,596,376 | B2 * | 12/2013 | Holverson et al. | 172/811 |
| 2009/0307941 | A1 | 12/2009 | Gamble, II | |

* cited by examiner

*Primary Examiner* — Robert Pezzuto
(74) *Attorney, Agent, or Firm* — Sarah J. Rhoades

(57) ABSTRACT

The wing lock is a safety mechanism for a snow plow blade and is engaged when the plow blade is not in use. The safety mechanism is primarily a pin and tongue assembly which is actuated by an air, electric, or hydraulic cylinder tied to the truck on which the plow is mounted. The pin is protected by a collar and sleeve which are disposed below the actuator cylinder. The tongue is affixed on the support arm of the plow wing so that when the support arm is raised the tongue slides into a receiving position for the pin. The pin drops through the tongue to lock the blade. For use, the safety mechanism is activated or deactivated from the truck cabin by a lighted, electrical switch which sends a signal to the actuator to deploy or retract the pin so that the plow may be locked or unlocked.

6 Claims, 18 Drawing Sheets

FIG. 16.1

Hydraulic lines

WING LOCK FOR SIDE-MOUNTED SNOW PLOW

CROSS-REFERENCE TO RELATED APPLICATIONS

This patent application claims priority under 35 U.S.C. §119(e) to U.S. Patent Application Ser. No. 61/475,964, entitled "Wing Lock for Side-Mounted Snow Plow," and filed on Apr. 15, 2011, which application is now pending. The entire disclosure of that provisional patent application is hereby incorporated by reference.

STATEMENT REGARDING FEDERALLY SPONSORED RESEARCH OR DEVELOPMENT

Not applicable.

REFERENCE TO A "SEQUENTIAL LISTING," A TABLE, OR COMPUTER PROGRAM LISTING APPENDIX SUBMITTED ON A COMPACT DISC

Not applicable.

BACKGROUND

1. Field of the Invention

This invention relates to plows for vehicles, trucks and snow plows, and more particularly to such a safety device which may be selectively engaged to lock and unlock a snow plow wing from a remote location such as the vehicle cabin.

2. Description of the Related Art

Snow removal has been a problem for as long as motorized vehicles have used public roadways for transportation. In response to the task of removing significant quantities of snow away from roadways, driveways and parking lots, many different types of snow plowing arrangements have been invented. For example, snow plow blades may be mounted either to the front of the plow vehicle, to the side of the vehicle, or both. Side-mounted snow plow blades are frequently called wings.

Side-mounted snow plow wings are deployed to the vehicle side for use and retracted to an upright position when not in use or when the vehicle is traveling between uses. A joystick in the cabin of the truck is typically used by the driver to move the wing between deployed and retracted positions. However, the only current means to safely lock a retracted wing and prevent it from dropping down into a deployed position is by manually attaching safety chains. Safety chains are located on the exterior side of a truck where the wing is located and the chains are fastened between the vehicle and the wing. A wing can only be deployed when a safety chain is detached. Thus, when wings are needed to be deployed the driver must exit the vehicle cabin in order to manually latch or detach the safety chains. Exiting the cabin presents a number of hazards to the driver. Oncoming and passing traffic may not see the driver in adverse weather conditions where visibility can be very low. Bad roads can make it difficult for oncoming traffic to avoid a collision with an exposed driver. During implementation or removal of the safety chain, the chain may break and cause the wing to drop unexpectedly, injuring the driver. For these and other safety reasons, there is a need in the industry to reliably lock a snow plow blade into a predictable and secure position.

BRIEF SUMMARY OF THE INVENTION

The present invention for a wing lock for side-mounted snow plow wings generally comprises a pin assembly with actuating means and a pin receiving means. The pin assembly comprises a pin disposed and protected inside of a sealed sleeve or tube which is joined with an actuator cylinder via a collar. In the preferred embodiment, the pin assembly is affixed to the plow or truck frame by a support tower and base. All aspects of the base and support tower structures will necessarily vary between models of trucks and snow removal vehicles. The pin receiving means first comprises a tongue which may be affixed to the support arm of the snow plow wing. The pin receiving means also comprises one or two holes a portion of the base. The two pin receiving means cooperate to receive the pin and thereby lock the wing. The snow plow operator uses an electrical control switch or other trigger with an indicator light to trigger or signal the actuator cylinder to either unlock or release and lock the wing of the snow plow with the pin.

For use, the switch is engaged, the pin retracts, the light illuminates, and the wing is ready for operation. Upon engagement of the switch an electrical signal is transferred to the actuator which may be an air actuator or an electrical or hydraulic actuator. After the pin has retracted and cleared the tongue receiving means, the wing is unlocked and the driver may control the wing by joystick or other known method. Previously, the joystick could only control the support arms or mechanisms supporting the wings of the snow plow after the manual removal of safety chains. The present invention will dispose of any such need and also provide the ability to safely engage, disengage, and re-engage the snow plow wing from the safe, remote confines of the cabin of the plow vehicle.

In other terms, the present invention can be understood to be a latch for securing a snow plow wing in an upright, stowed position by incorporating a locking member, a cooperating member to receive the locking member, a holding member whereby the holding member selectively stores or releases the locking member to move to the cooperating member, and then a signaling means which activates the holding member to optionally hold or release the locking member.

By using the present invention, the operator enters the cabin of the truck once and remains in the cabin throughout his plow route. No safety chain is needed or used during the plowing operation. If a chain is still used for long-term storage of the truck and side-mounted plow the chain would be detached only once before operation and in the shelter of the garage or shop. The chain would then remain detached until the vehicle is returned to the garage or shop. At any time during a plowing route, the operator may retract and lock the wing into an upright position without exiting the vehicle cabin. With the present invention, the wing remains safely pinned in the upright position, but ready for immediate deployment and then use. With the use of the present wing lock, the accidental lowering of the snow plow wing because of hydraulic or other component failures is prevented. For use, the operator merely engages the deployment electrical switch pre-installed or integrated into the dash of the truck cabin. Such implementation will be particularly useful in areas where the snow plow wings are frequently moved up and down, such as when plowing and maneuvering in urban settings.

The foregoing has outlined, in general, the physical aspects of the invention and is to serve as an aid to better understanding the more complete detailed description which is to follow. In reference to such, there is to be a clear understanding that the present invention is not limited to the method or detail of construction, fabrication, material, or application of use described and illustrated herein. Any other variation of fabrication, use, or application should be considered apparent as an alternative embodiment of the present invention.

BRIEF DESCRIPTION OF THE DRAWINGS

The following drawings further describe by illustration, the advantages and objects of the present invention. Each drawing is referenced by corresponding figure reference characters within the "DETAILED DESCRIPTION OF THE INVENTION" section to follow.

FIG. 16.1 schematically demonstrates one bolt plate option for affixing the support tower on the base of the wing lock.

DETAILED DESCRIPTION OF THE INVENTION

Figure 1:
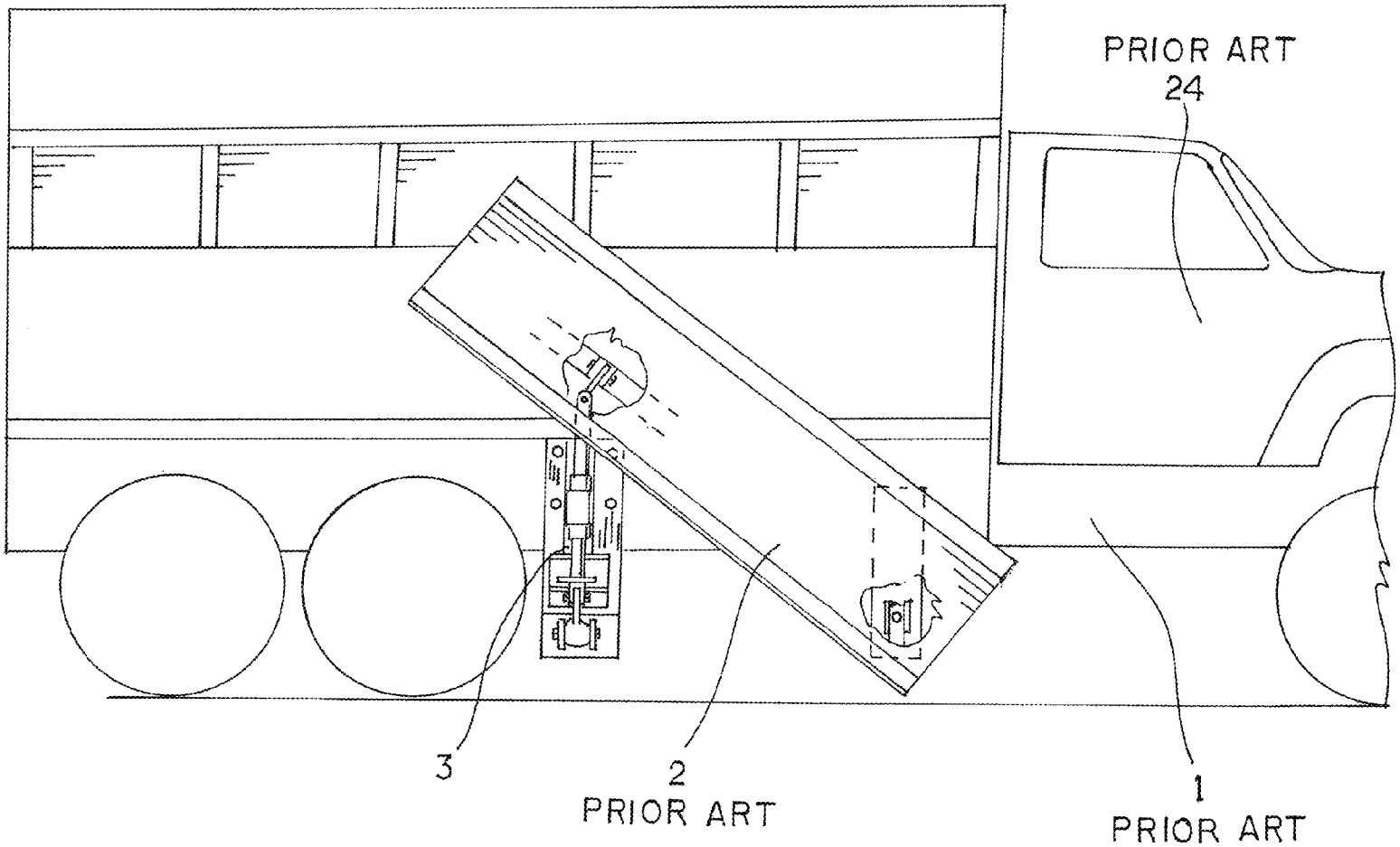
FIG. 1 is a partial, side elevation view of a common truck having a known, side-mounted snow plow in a stowed position.
Figure 2:
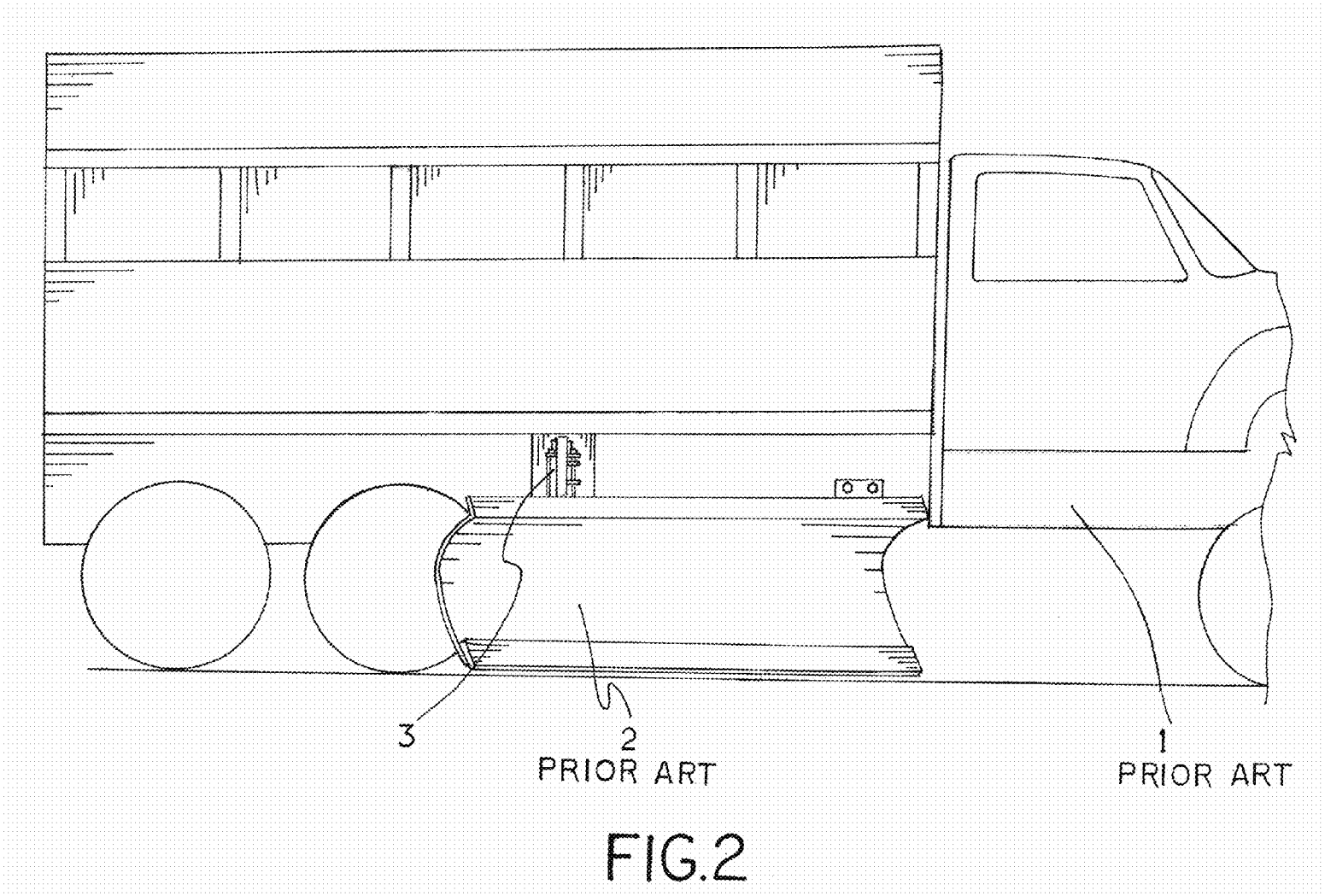
FIG. 2 is a partial, side elevation view of a common truck having a known, side-mounted snow plow in a position for plowing.
Figure 3:
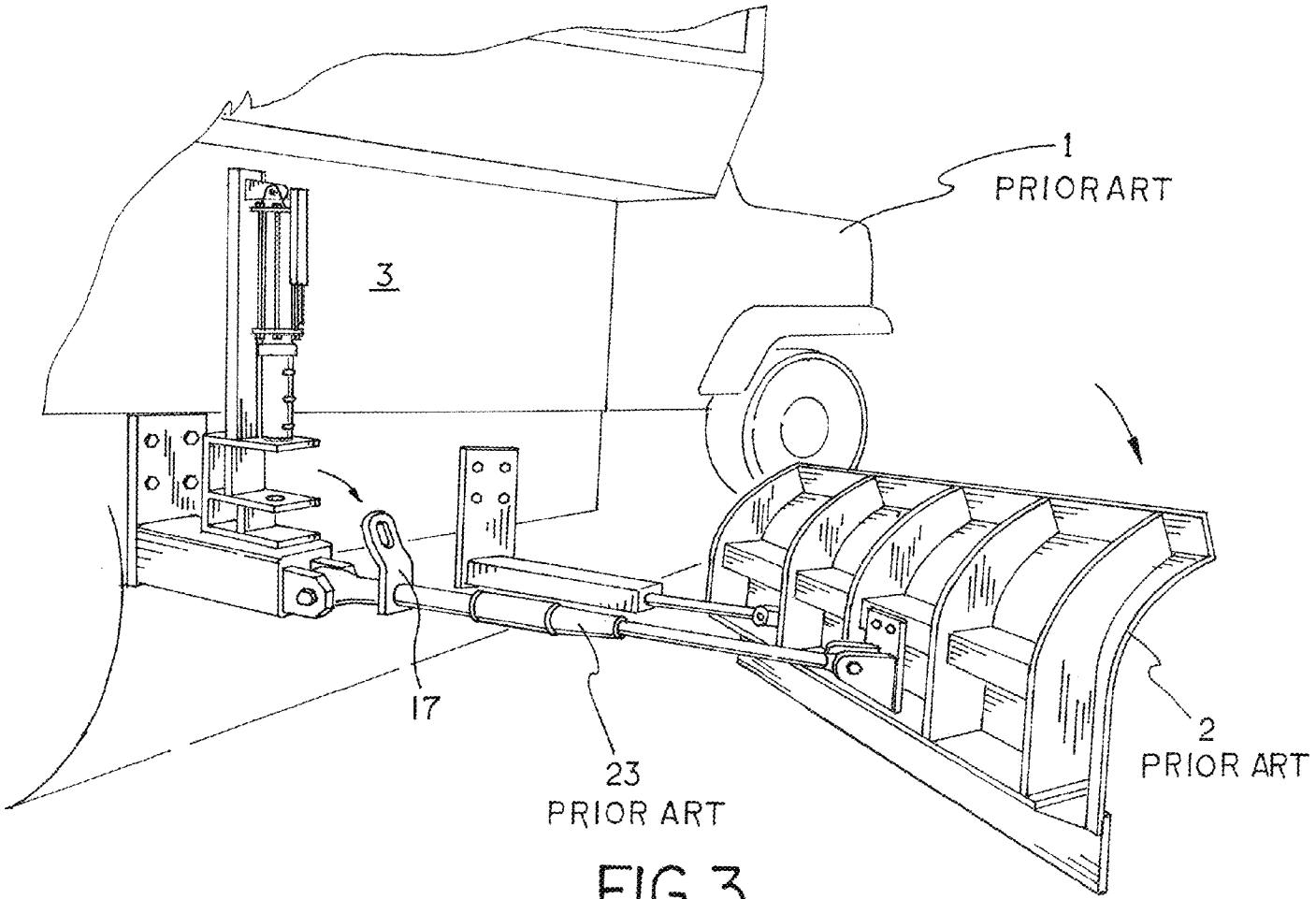
FIG. 3 is a partial rear, perspective view of a truck with a plow wing deployed for plowing and also demonstrating the present invention in use on the plow wing frame.

The wing lock 3 including the tongue 17 of the present invention is demonstrated in context, from afar in FIGS. 1-3. FIGS. 1-3 illustrate a common truck 1 used for plowing. This plow vehicle has a snow plow wing 2 mounted on its side, meaning it has a side-mounted snow plow wing. Referring to FIG. 1, when the snow plow wing 2 is not in plowing use, the plow wing 2 is raised into a stowage position wherein the blade is folded, much like a wing, along the side of the truck 1. The snow plow wing 2 must be deployed, or lowered for plowing use. See FIGS. 2-3. Portions of the drawing in FIG. 1 are torn away to show the attachment points for the snow plow wing 2 to the truck 1 (or vehicle). In FIGS. 1-3, the location of the wing lock 3 embodiment and its tongue 17 are shown in relation to the truck 1, the cabin 24, the raised or lowered plow wing 2, and the wing support arm 23.

Figure 4:
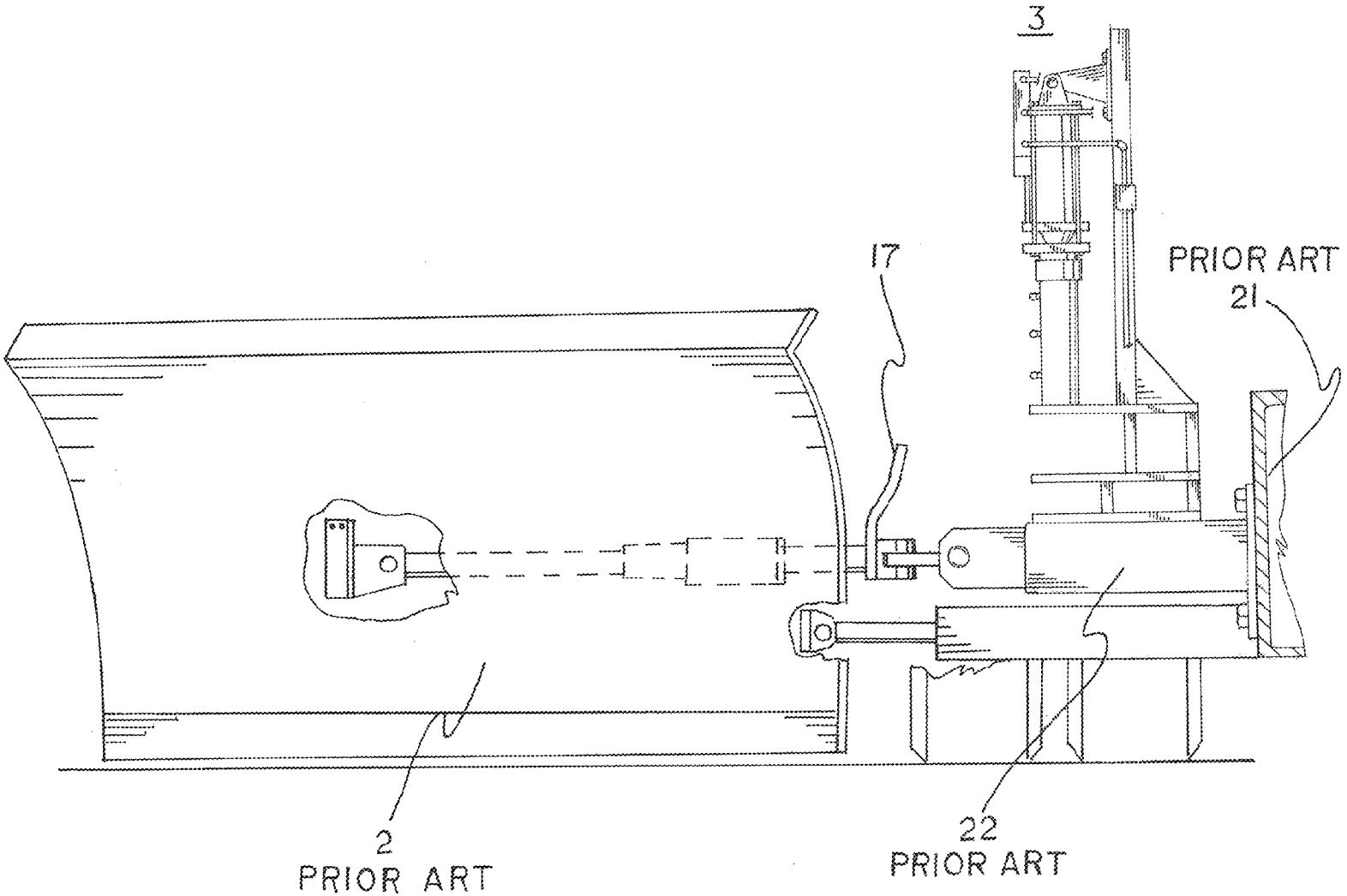
FIG. 4 is a partial, front plan view of a plow wing deployed for use and also showing the present invention mounted on the plow wing frame 22.
Figure 5:
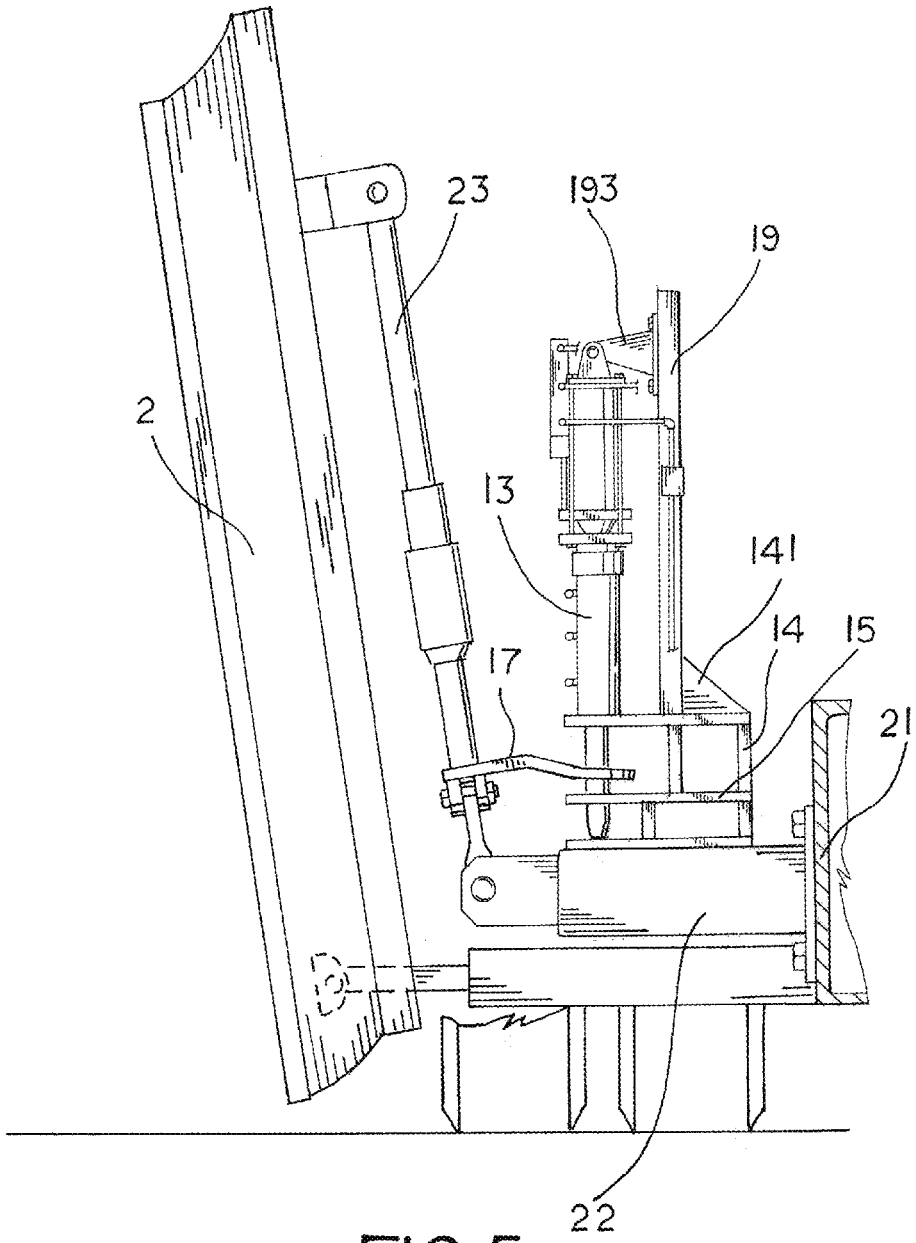
FIG. 5 is a partial, front plan view of the plow wing in a retracted position and locked by the present invention.

The front plan views of FIGS. 4-5 further demonstrate the location of the wing lock 3 and tongue 17 relative to the plow wing 2, the plow wing frame 22, and the truck frame 21. Referring to FIG. 4, the plow wing 2 is ready for plowing use because the wing lock 3 is unlocked and the pin is retracted into its sealed sleeve. In FIG. 5, the plow wing 2 is locked in its upright, safety position because the pin is released from its sleeve 13 and cleaves the holes of the tongue 17 and the base 14 and clevis 15 of the wing lock 3. The tongue 17 is attached to the wing support arm 23. The base is attached to the wing frame 22 that is affixed to the truck frame 21. The plow wing 2 may again be prepared for deployment and plowing use by the driver of the truck who triggers the retraction of the pin 12 by the flip of a two-way switch in the truck cabin 24. The movement of the pin 12 retraction is shown by an illustrated arrow in FIG. 6. With the retraction of the pin 12 into the sleeve 13, the tongue 17 is again free from the pin 12 and the base 14 and may pivot with the wing support arm 23 and the plow wing 2 into a plowing position.

Figure 6:
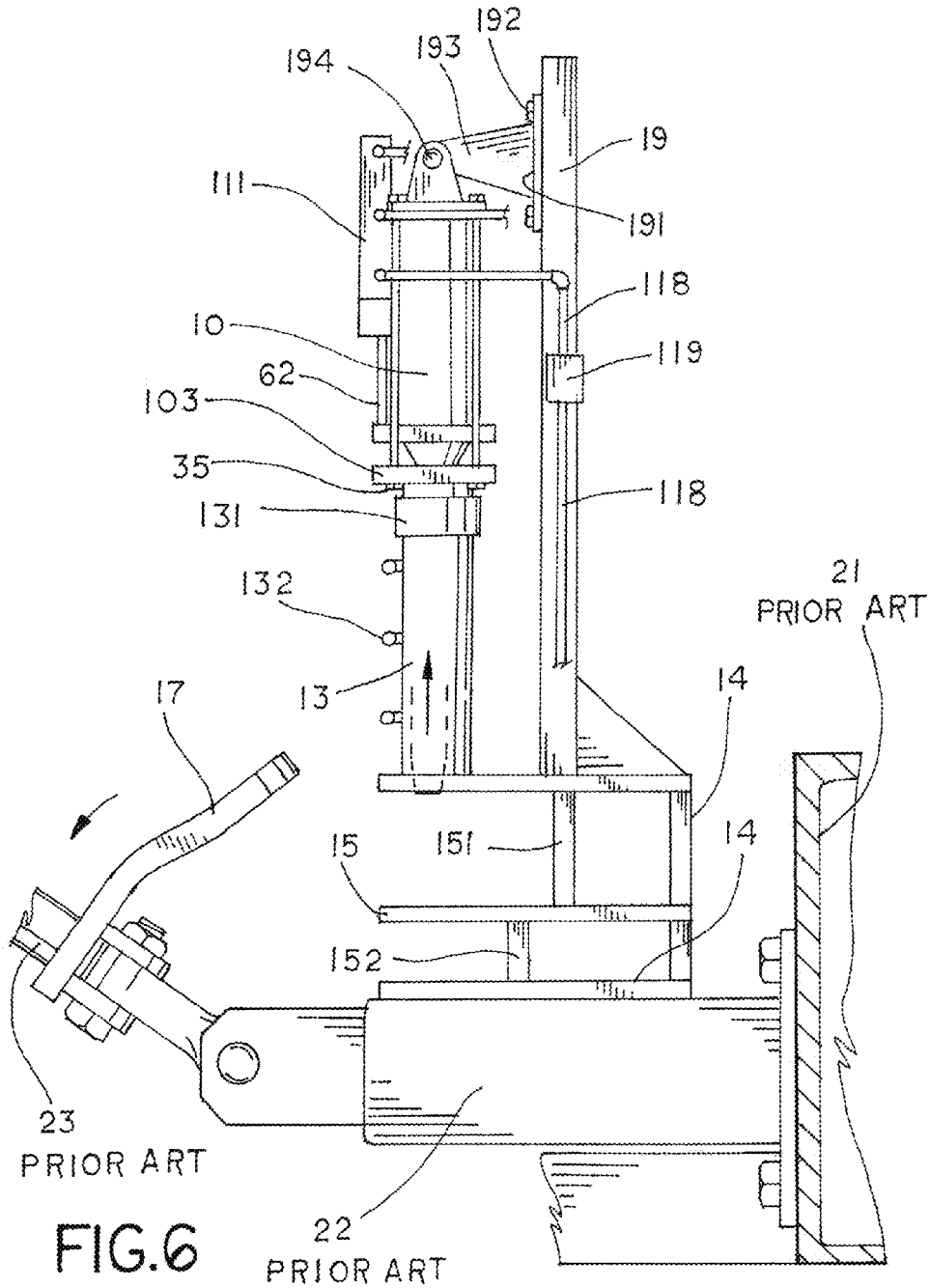
FIG. 6 is a front plan view of the present invention mounted on a wing frame 22 and a partial view of a deployed wing support arm 23.
Figure 7:
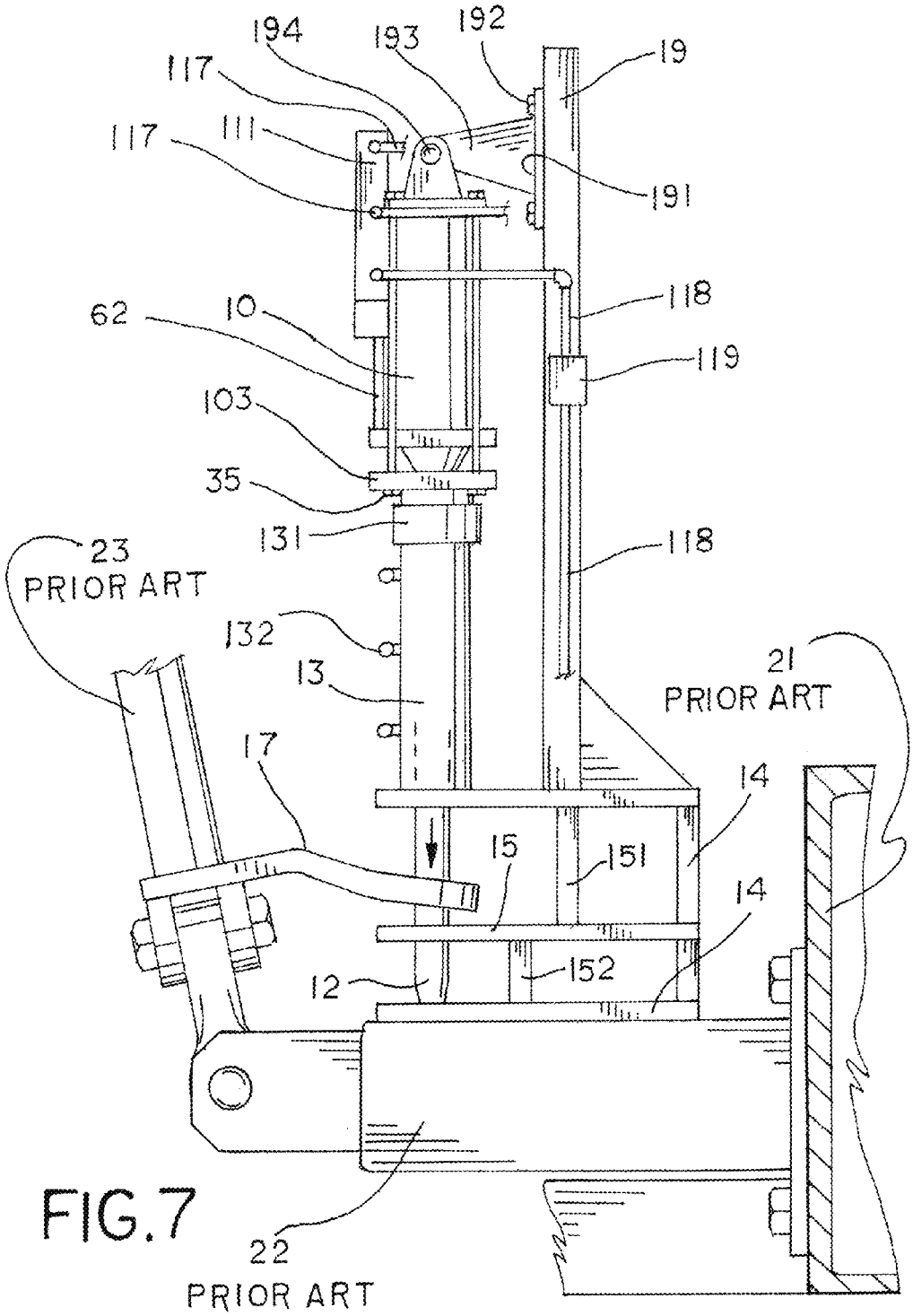
FIG. 7 is a front plan view of the present invention mounted on a wing frame 22 and a partial view of a locked wing support arm 23.
Figure 8:
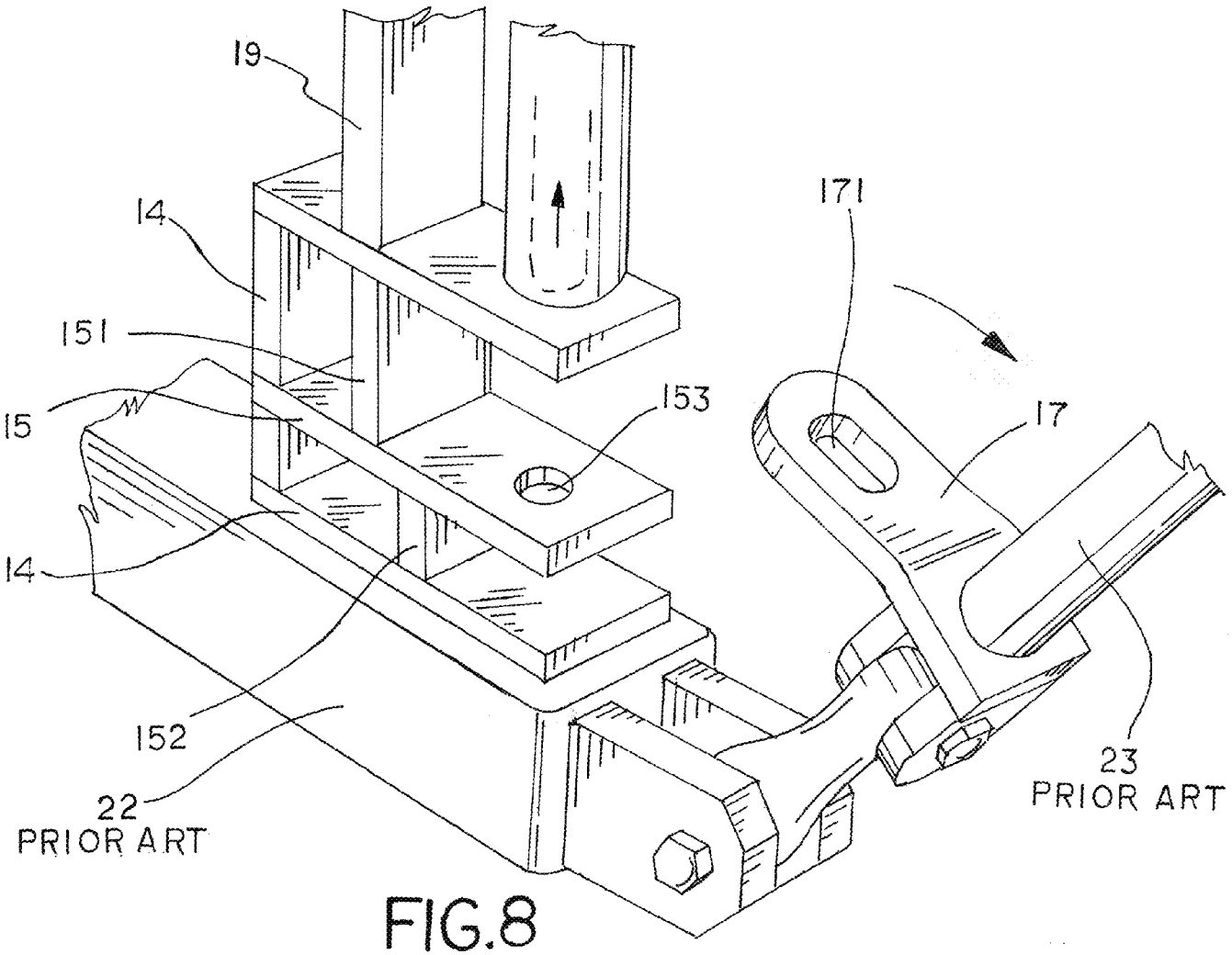
FIG. 8 is a partial, rear perspective view of the present invention mounted on a wing frame 22 and a partial view of a deployed wing support arm 23.
Figure 9:
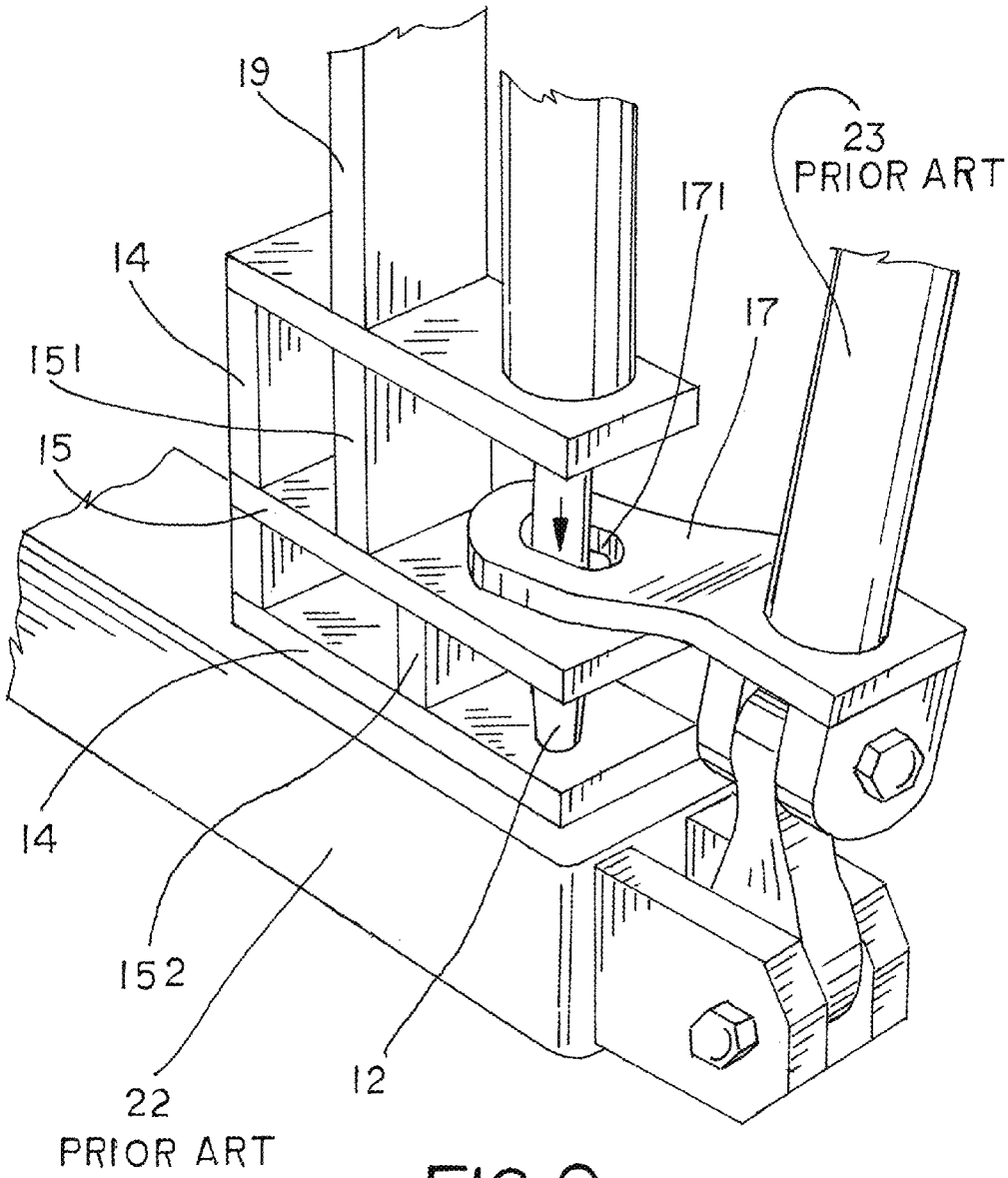
FIG. 9 is a partial, rear perspective view of the present invention mounted on a wing frame 22 and a partial view of a locked wing support arm 23.
Figure 10:
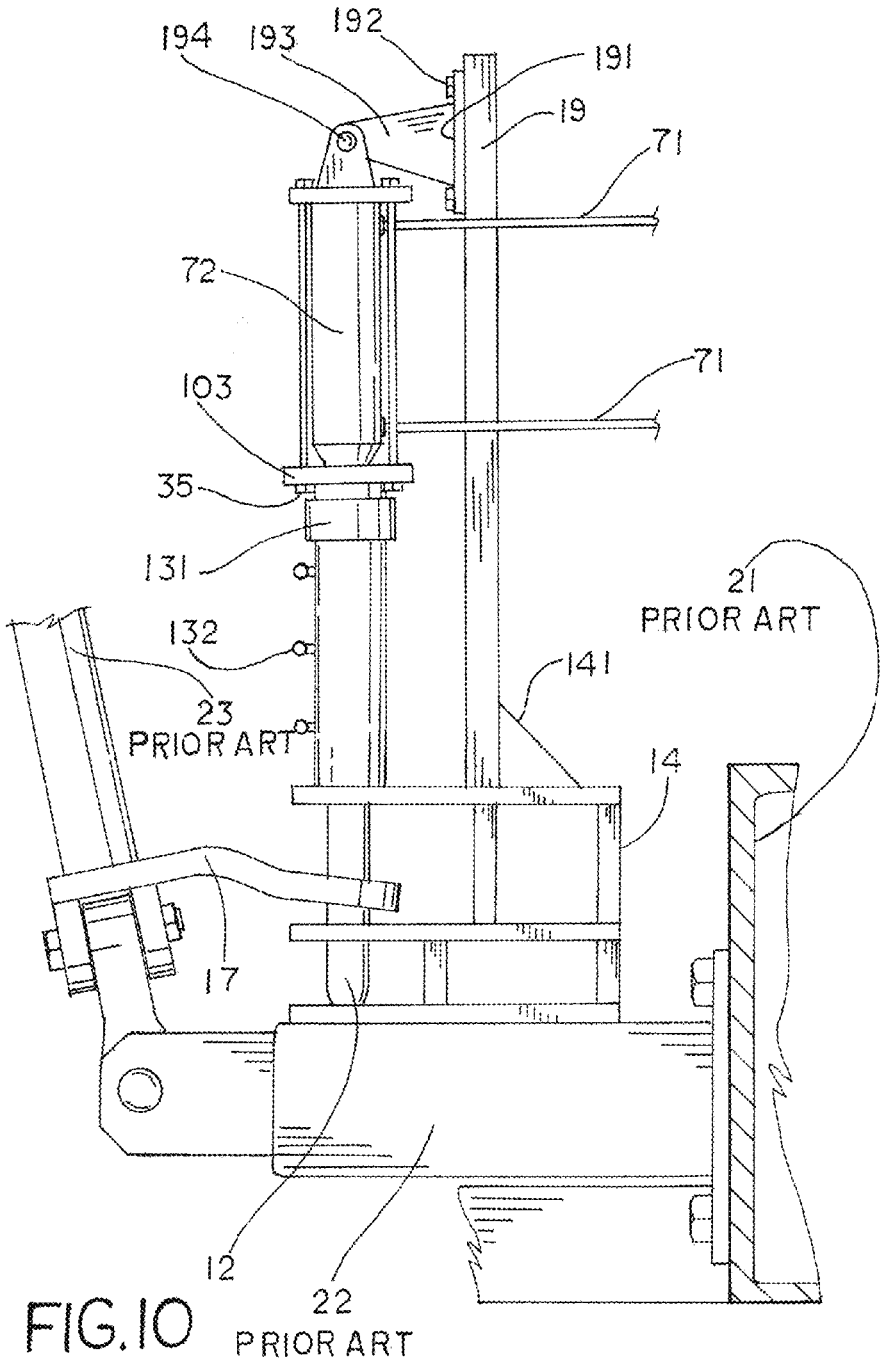
FIG. 10 is a front, plan view of a hydraulic actuated wing lock 3 as from the front of the truck 1. The wing lock 3 is demonstrated with the pin 12 in the locked position.

The components first shown in FIGS. 3-5, are set out, according to one embodiment of the wing lock 3, in FIGS. 6 and 7. The clevis 15 and base 14 are substantially integrated and mounted on the wing frame 22 which is affixed to the truck frame 21, or on the truck 1 directly. This demonstrates one embodiment, but the frame structures of the wing lock including the base configuration must be customized to the existing structures of various plow vehicles. According to the illustrated embodiment of the invention, the clevis 15 portion of the base support may be simply a plating of metal with a hole 153 therein to receive the elongated shaft, or pin 12. See additional detail of the clevis hole in FIG. 8.

The clevis 15, which is part of the lock assembly will be raised up away from the base of the frame a few inches in order to align with the tongue 17 on the plow wing 2. The lock assembly, particularly the tongue 17 and clevis 15 must be manufactured on a bench in order to align them and their respective, first and second pin receiving holes or openings shown from the front in FIGS. 6-7 and in perspective in FIGS. 8-9. During the manufacturing process the base 14 and the tongue 17 are properly tacked or welded to the truck frame 21 or wing frame 22 and the support arm 23. In one embodiment such as that shown in FIG. 5, the support tower 19, welded to the base 14, is additionally supported by a gusset 141. A series of gaps and corresponding spacers must be formed into the base 14 to allow clevis 15 and tongue 17 coordination. In one embodiment, the spacers may be 1 inch by 4 inches and then differ in heights. These gaps and spacers 151 and 152 are indicated in FIGS. 6-9.

Figure 16:
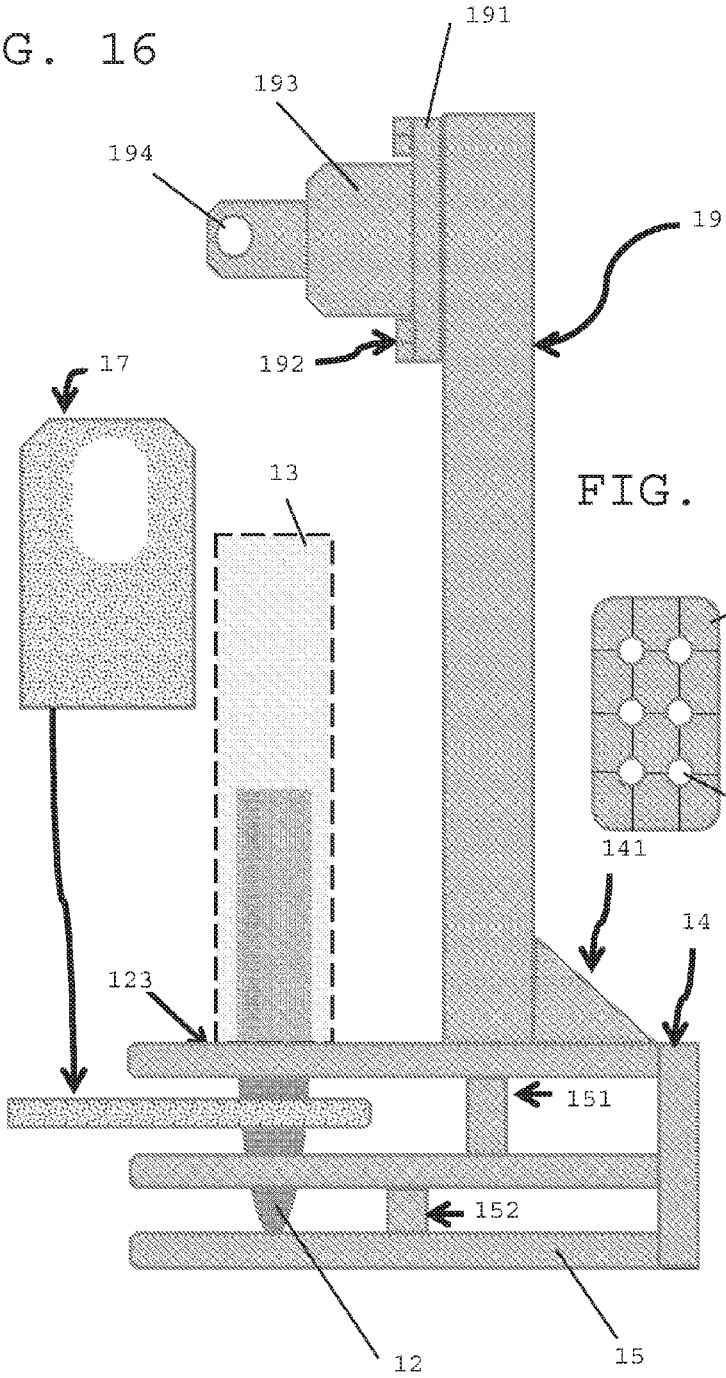
FIG. 16 is a schematic, partial view of the wing lock as from the front of the truck but with the actuating means removed and the pin 12 shown in phantom inside the sleeve 13 and in a released and thus, locked position.
Figure 16:
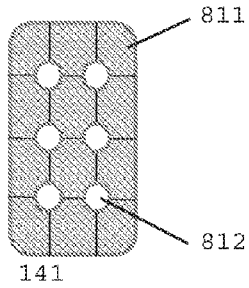

The following materials and sizing are known to be preferred for a particularly common truck model. The clevis 15 will be fabricated from ½ inch plate metal having a hole 153 therein. The clevis 15 will be welded to the base 14, but in the preferred embodiment may have a small gap with a first spacer 152 (around 1.5 inches) and a larger gap with a second spacer 151 (about 3 inches). See FIGS. 6-9. In the preferred embodiment, the support tower 19 is a 3 inch channel. The support tower 19 will be welded to the base 14, but it may alternatively or additionally be bolted with our without a gusset. FIG. 16.1 demonstrates one option for a bolt plate 811 and related bolt pattern of holes 812 for affixing the support tower 19 to the base 14 of the wing lock 3. In this optional bolt plate pattern, the bottom of the plate is 4 inches by 9 inches and the bolt holes are ½ inch wide and 1 inch from the edge of the plate and 1 inch apart on all sides. A gusset 141, if used, may be 3 inches by 3.5 inches thick. The tongue 17 is ½ inch by 4 inches by 9 inches with a 2 inch by 1.5 inch elongated hole 171 shown in FIGS. 8 and 9. The clevis 15 may be plating 9 inches by 4 inches by ½ inch and the upper two plates have a 1.25 inch hole 153 below and centered below the sleeve which houses the elongated shaft of the pin in a partially or wholly sealed manner.

Referring to FIGS. 6 and 7, the pin assembly is joined with the top of the support tower 19 by a tower arm plate 191, fastening means 192, a tower arm 193, and a tower arm pin 194. The tower arm plate 191 may be 5 inches in height. The fastening means 192 holding the tower arm 193 and tower arm pin 194 in place comprise bolts such as bracket bolts ⅜ inch by 1½ inches. Also, in the preferred embodiment, the tower arm pin 194 is measured and cut in conjunction with the throw of the cylinder, but is formed to be minimally longer so it will not reach the end of the throw of the cylinder and prevent any up and down play. The tower pin arm 194 should have its hole center half way between the widest dimension of the tower plate 191. Regardless of the details of attachment for the vehicle's needs, the pin assembly is attached to the frame mounting components by an attachment means formed to hold the cylinder actuator 10 above or in a vertical position from the sleeve 13 and locking pin 12. A more compact cylinder may result in a more compact pin assembly. In such case, the support tower 19, pin and sleeve may also be shorter.

Figure 11:
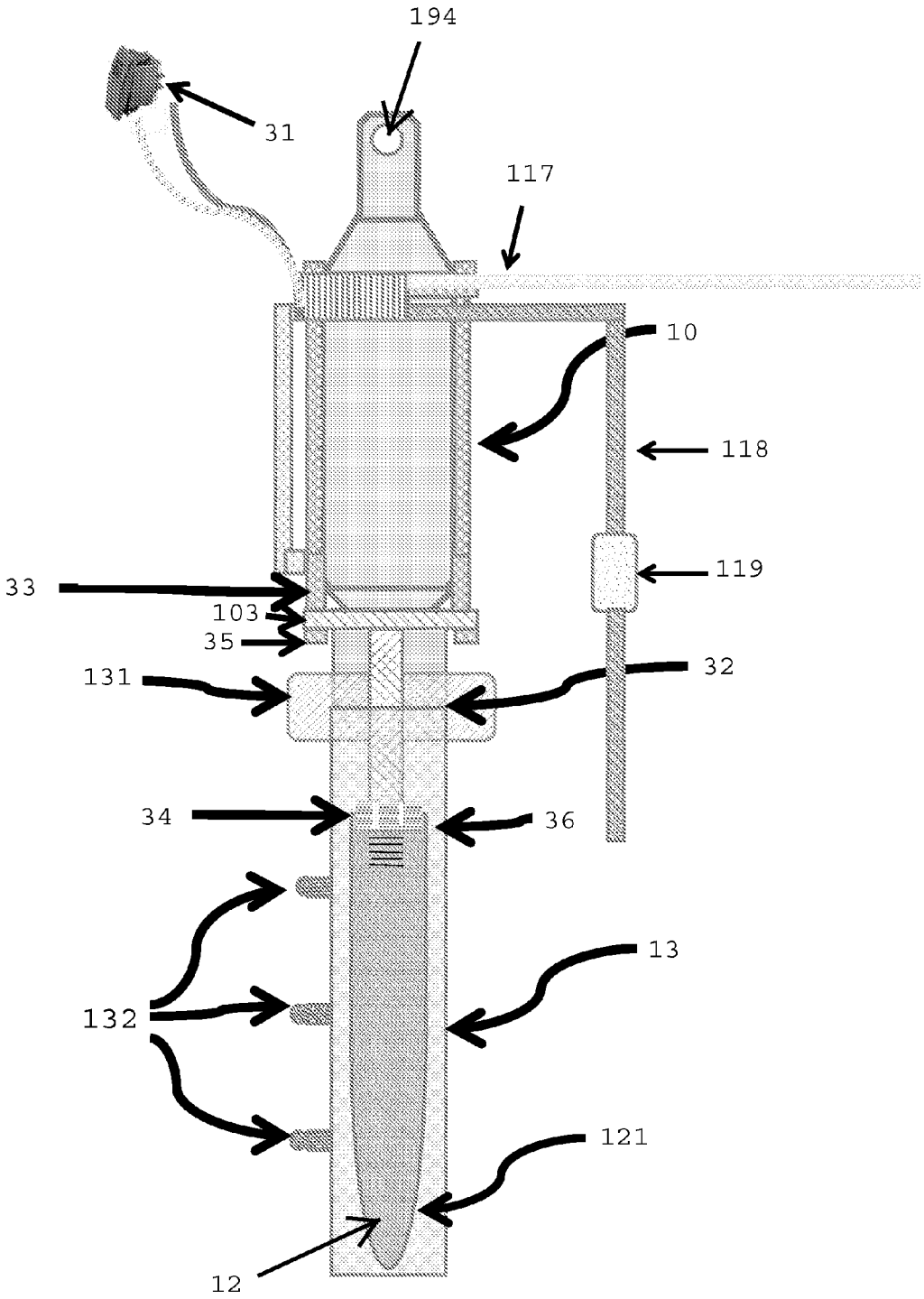
FIG. 11 is a schematic, cross-sectional view of an air actuated wing lock as from the front of the truck. The pin 12 of the wing lock is demonstrated in a retracted or unlocked position.
Figure 12:
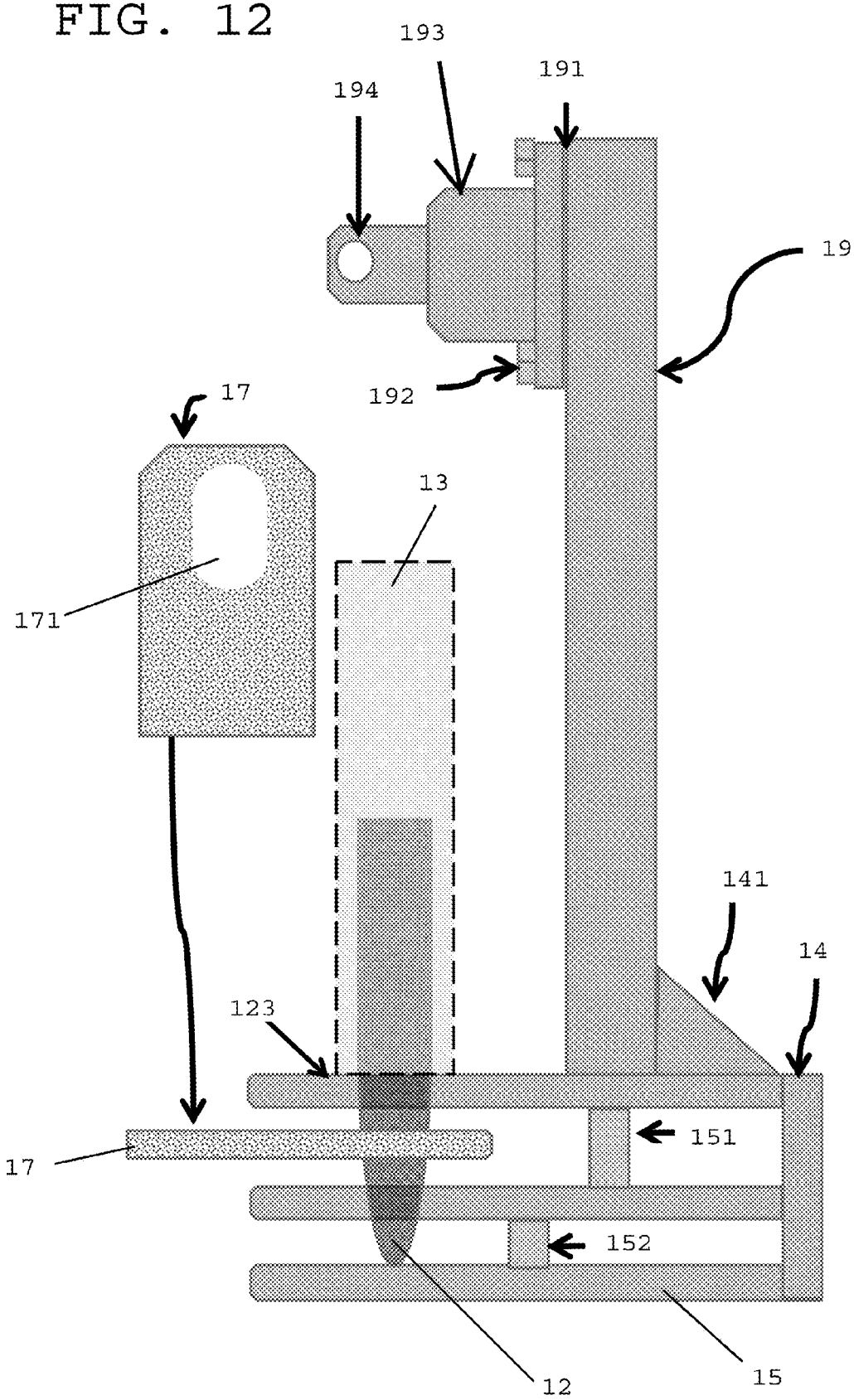
FIG. 12 is a schematic, cross-sectional view of the wing lock as from the front of the truck but with the actuating means removed and the pin 12 shown in phantom inside the sleeve 13 and in a locked position.

One manner in which to join the air actuating means with the locking pin 12 is by drilling a hole in the side of the air cylinder 10. In another embodiment, the pin is drilled and tapped 36 (See FIGS. 11 and 15) to ⅝ inch national fine (nf) thread (female) to receive the air cylinder 10 shaft and then a jam nut or lock nut 34 is used to keep the pin and cylinder in place. The pin 12 may be 1⅛ inch by 11 inches of cold roll tapered at one end 121 and drilled and tapped to ⅝ of at the upper end. The top end of the pin 12 receives the bottom of the cylinder's shaft. The collar 131 is installed on to the cylinder with a coupling means such as 5⁄16 inch coupling nuts 33 or any other bolting system that will coordinate with the four inch by four inch plate 103 of the cylinder's structure in order to hold the necessary configuration. The collar 131 over the sleeve 13 helps prevent corrosion because no moisture can penetrate the sleeve 13 itself. In the preferred embodiment, the sleeve 13 is split under the collar 131. The split or seam 32 in the collar 131 allows the grease to fill the collar 131 and the grease further prevents corrosion. Cross-referencing FIG. 11 with schematic views of FIGS. 12 and 16, one will appreciate the location of the 360 degree sealing weld 123 which is made around the point of joinder between the clevis 15 and the sleeve 13. In the preferred embodiment, the sleeve 13 is approximately 11 inches long and 1.5 inch inside diameter (ID) by 2½ inches outside diameter (OD). In this embodiment, the other end of the sleeve 13 is welded to a 4 inch by 4 inch plate 103 which is then bolted through the bolt sleeve 35 to the cylinder 10 with bolts such as 5⁄16 inch by 1 inch bolts. Moisture and corrosion are non-factors because of the sealing effects of the combination of the collar 131 and grease with the sleeve 13. Three grease zerts 132 (5⁄16 inch in the preferred case) are demonstrated in FIGS. 11, 15, and 6-7. Any number or combination of grease zerts 132 may be used in order to accomplish the objectives of the invention. Any variation in specific hardware components may be used so long as the objectives of the invention are met.

As demonstrated in FIGS. 6, 10, 12, and 16, the cylinder 10 and pin 12 have enough clearance so that the assembly can float or hang suspended in the sleeve 13. The shaft of the locking pin 12 should be 1⅛ inches or lathed or machined or otherwise formed to reduce its circumference to allow sufficient welding and grease cavity clearance. The clearance of the pin 12 in the sleeve 13 coupled with the use of grease should prevent any issue with the pin 12 locking in the sleeve 13. Also, the pin 12 will travel through the tongue 17 and clevis 15 holes more freely. The holes in the clevis 15 and the tongue 17 are drilled with clearance over the pin. In the preferred embodiment, ⅛ inch is sufficient overage. The tongue hole 171 is elongated for easier alignment and this feature is best appreciated from the partially exploded top perspective view of the pin locking mechanism in FIGS. 8 and 9.

The default, locked, pin-released position of the wing lock as actuated by the air cylinder is shown in FIG. 7. With the plow driver's trigger, the control valve 111 begins the release of air from the air supply 117 which activates the air cylinder 10. See additional discussion of the air actuation schematic in FIG. 14 below. In this embodiment, the air cylinder 10 is the actuating means to retract the pin 12 into the sleeve 13 and hold in it second, unlocked position, away from the tongue 17 as shown in FIG. 6. The tongue 17, which is welded to the existing snow plow wing support arm 23, is then free to pivot with the plow wing as the driver operator moves the wing 2 into plowing position. Air is supplied by any available means, but in one embodiment, an air supply 117 is tied to the air supply for the vehicle tailgate latch (not shown). From the control valve 111, pressurized air travels to the cylinder 10 by the air lines 62. After use in the air cylinder 10, air is released out of the air exhaust 118 and through the exhaust filter 119. The exhaust system is supported by and may be mounted to the support tower 19. In this embodiment, one protection valve services two cylinders.

Figure 13:
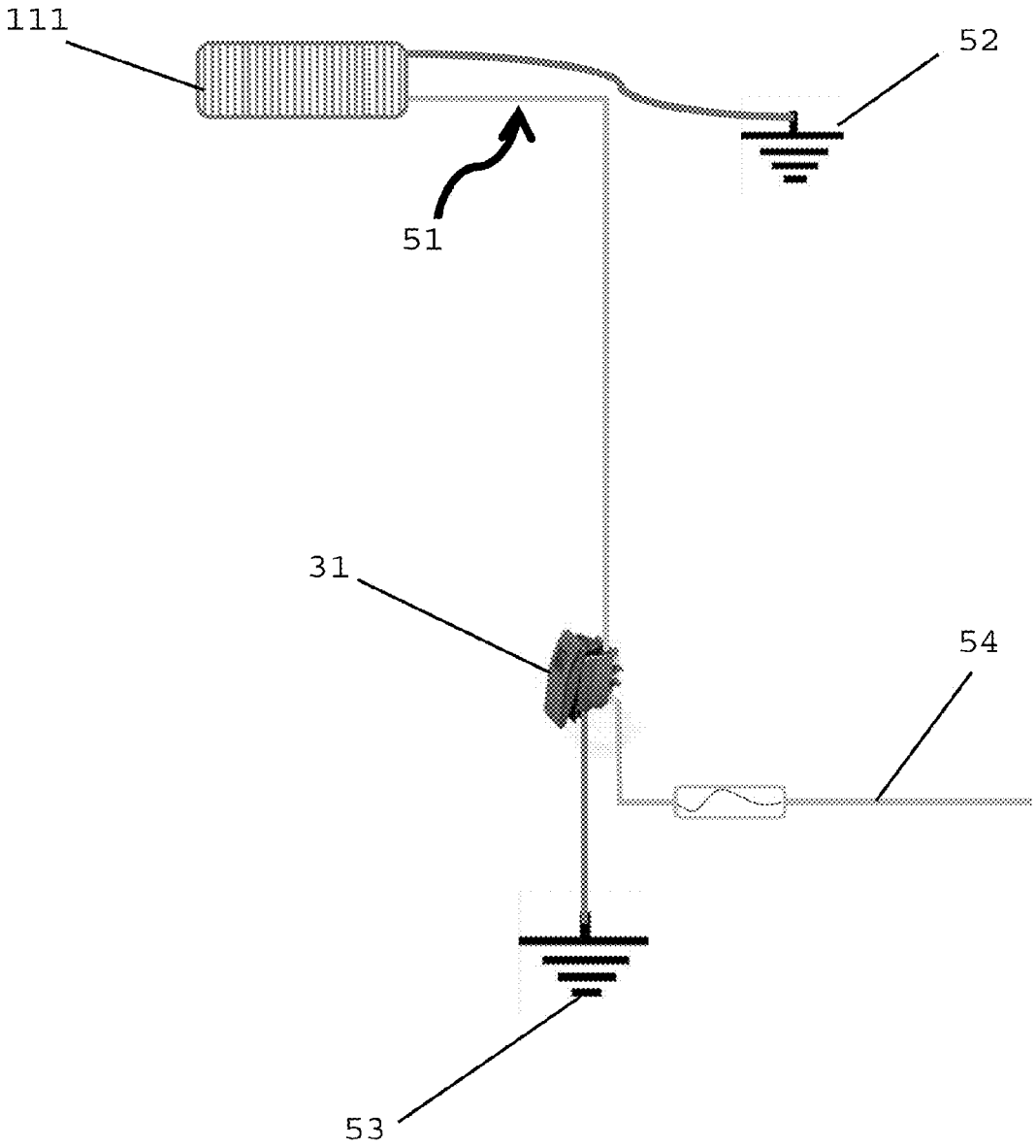
FIG. 13 is a schematic view of the electrical activation of the actuating means for the movement of the pin.

FIG. 13 presents a schematic representation of the supply of electricity to the air actuator of the present invention. Electricity must be supplied to the switch 31. One embodiment uses an auxiliary switch already installed in the truck dashboard. The preferred lighted control switch 31 will have an amber light incorporated into the switch, but any known switch with light or other visual indicator and in any combination will suffice. It is preferred that any employed trigger or switch be remotely located away from the plow wing. he visual indication should be on the dashboard of the truck or in another location immediately around the driver. In the preferred embodiment, when the lock is disengaged the light of the lighted control switch 31 illuminates indicating to the driver that the wing is unlocked. When there is loss of power, such as when the switch is turned off or when the key is turned off, the cylinder 10 returns the pin 12 to the locked position. Electric over air control valve 111 is powered by a power source such as DC Voltage 54. The surrounding components may have a weather pack connection 51 and have an in-cabin ground 52. In one embodiment, 25 feet of 14 gauge 2 strand wire is implemented. A fuse holder and fuse (not shown) are provided to meet the needs of the provided actuator. The rating of the fuse will depend on the demands of the actuator. One known selection for the switch will be a lighted rocker switch or toggle 31. The switch may have its own switch ground 53 also in the vehicle cabin 24. Again, wiring should desirably be coordinated so that when the light is 'on', the wing lock is in the unlocked or useable position. This is one selection for the indicator light illumination. Of course, the opposite principle could be implemented and convey the same information. When the key to the vehicle is in the 'off' position, the wing lock will automatically return to the locked position for safety reasons. In the locked position, the wing may not be employed.

Figure 14:
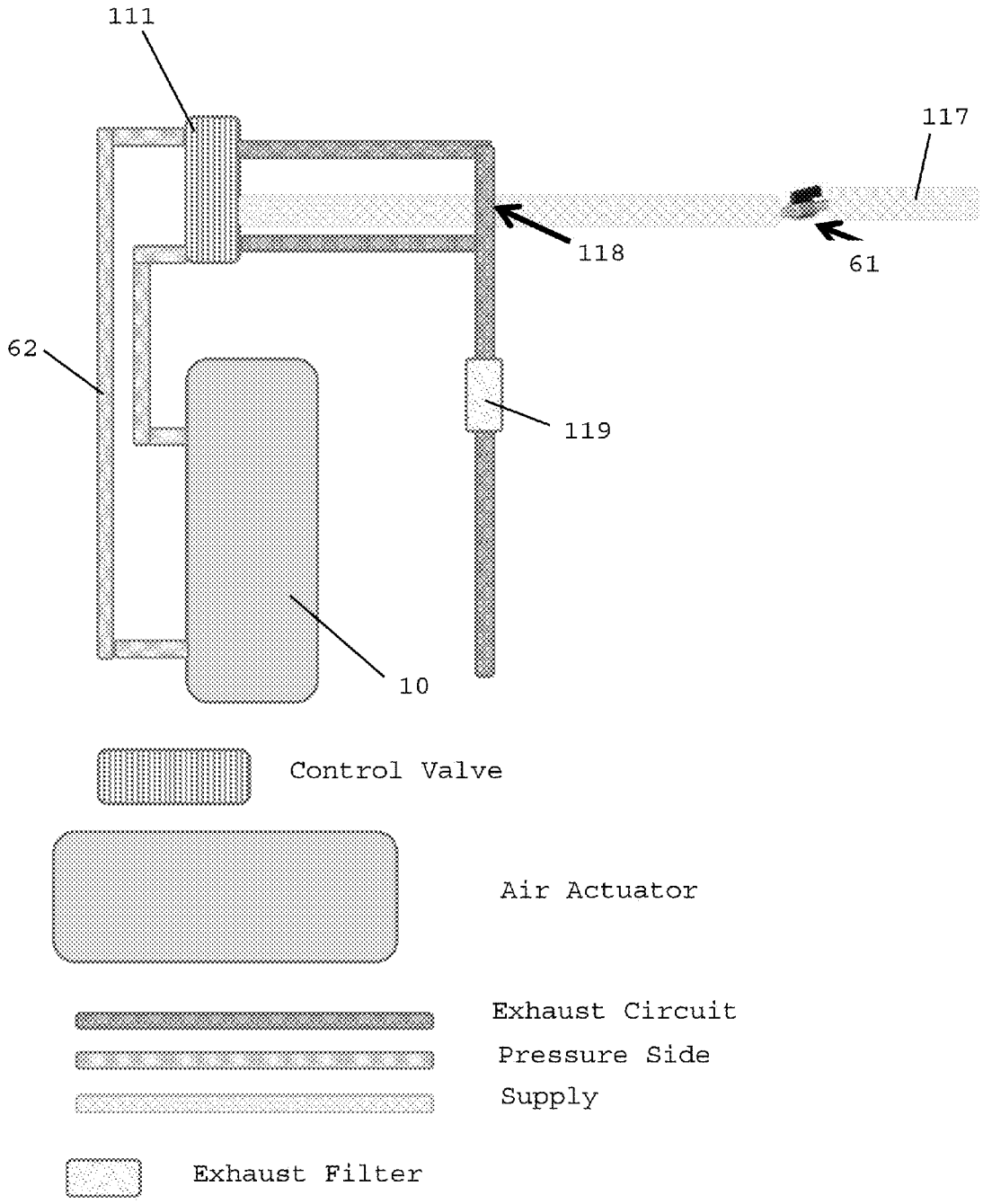
FIG. 14 is a schematic view of one manner in which to implement air actuated movement of the pin.

FIG. 14 demonstrates, in schematic, one known air actuation system as may be used in the present invention. The air supply line 117 receives an air supply. As stated in one embodiment, this will be from the tailgate supply line, but it may be taken from any other supply that has a tractor protection valve 61. In one embodiment, the tractor protection valve is designed to shut off around 70 psi so that the truck will not lose all of its air pressure in the event of a catastrophe to the air to the wing lock. The supply imposes pressure on the air actuator. Through the air supply components, the electric over air control valve 111 applies pressure through air lines 62 and activates the air actuator or cylinder 10. The exhaust filter 119 may be of a style like the Napa 3031 fuel filter. The exhaust line 118 may be a conduit such as a ⅜ inch fuel line hose (⅜ inch brass tee npt ⅜ barbed) for the exhaust side of the air supply components. In approximation, the air supply line 117 may be about ten inches of line while the exhaust line 118 may be about five feet of line.

Figure 15:
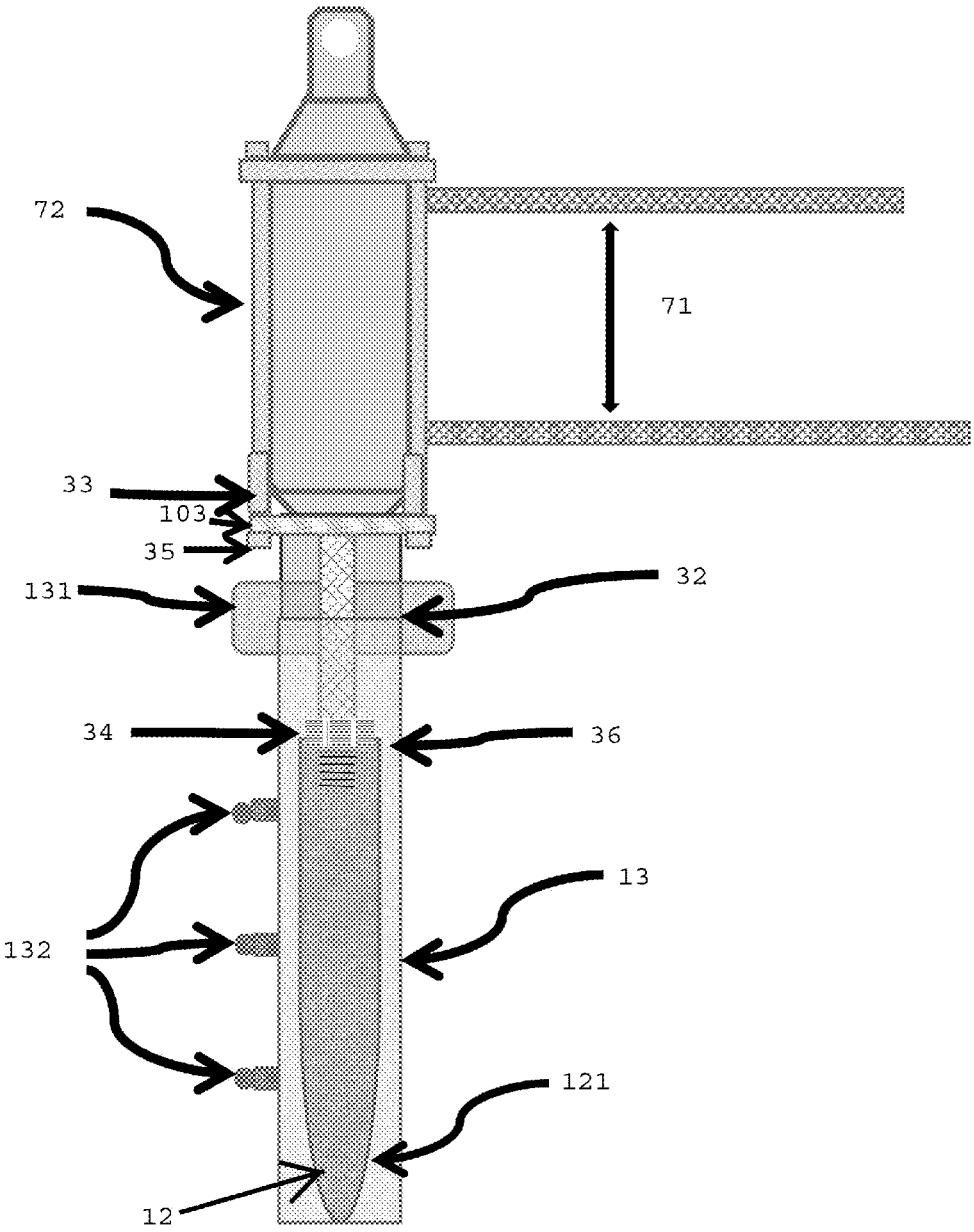
FIG. 15 is a schematic, cross-sectional view of a hydraulic-actuated wing lock as from the front of the truck. The pin 12 of the wing lock is demonstrated in a retracted or unlocked position.

As shown in the schematic, cross section in FIG. 15, the air supply and exhaust lines may be replaced with hydraulic lines 71 in the case that a hydraulic 72 is being used as the cylinder actuator (Part 10 in earlier drawings) moving the pin 12. A comparison of FIG. 10 with FIG. 15 and then FIG. 12 with FIG. 16 illustrates that the remaining components of the wing lock will remain substantially as they were regardless of the mechanism driving the actuator.

Figure 17:
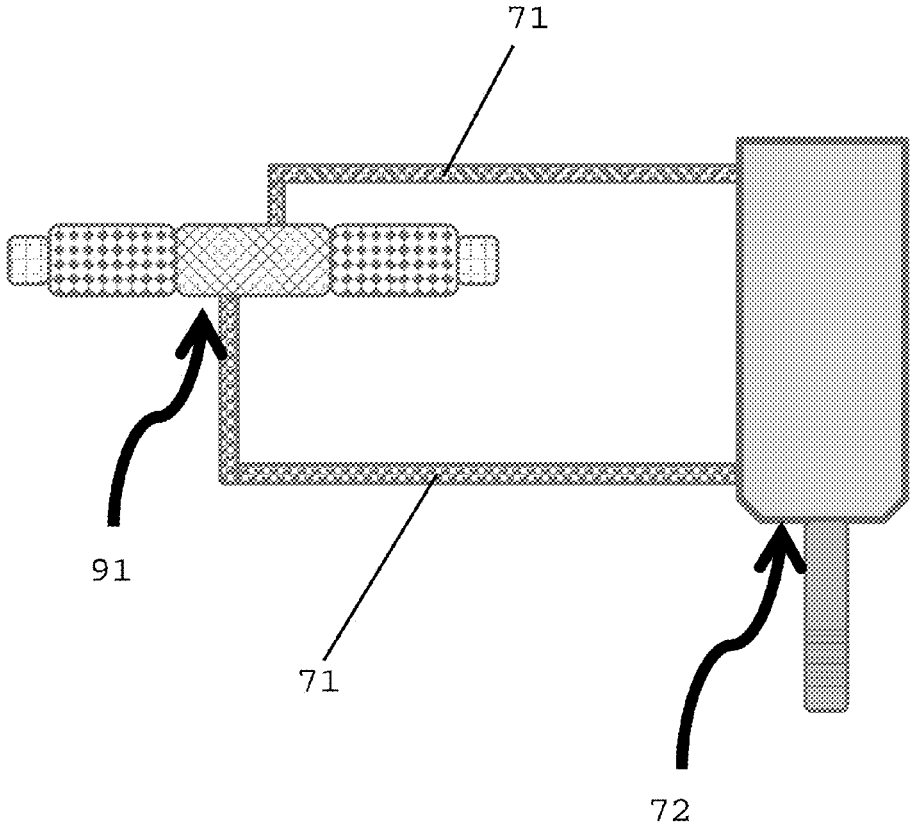
FIG. 17 is a schematic view of one manner in which to implement hydraulic actuation for movement of the pin.
Figure 17:
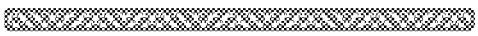

FIG. 17 demonstrates a schematic representation of how a hydraulic actuator 72 may be coupled with the pin assembly. The hydraulic valve 91 may vary from truck to truck depending on the hydraulic system used by the truck. Hydraulic lines 71 will connect the hydraulic valve control 91 to the hydraulic actuator cylinder 72. The hydraulic cylinder 72 will be similar to that demonstrated at Part 10 in FIGS. 6 and 7, but more similar to the cylinders shown in FIGS. 10 and 15.

Figure 18:
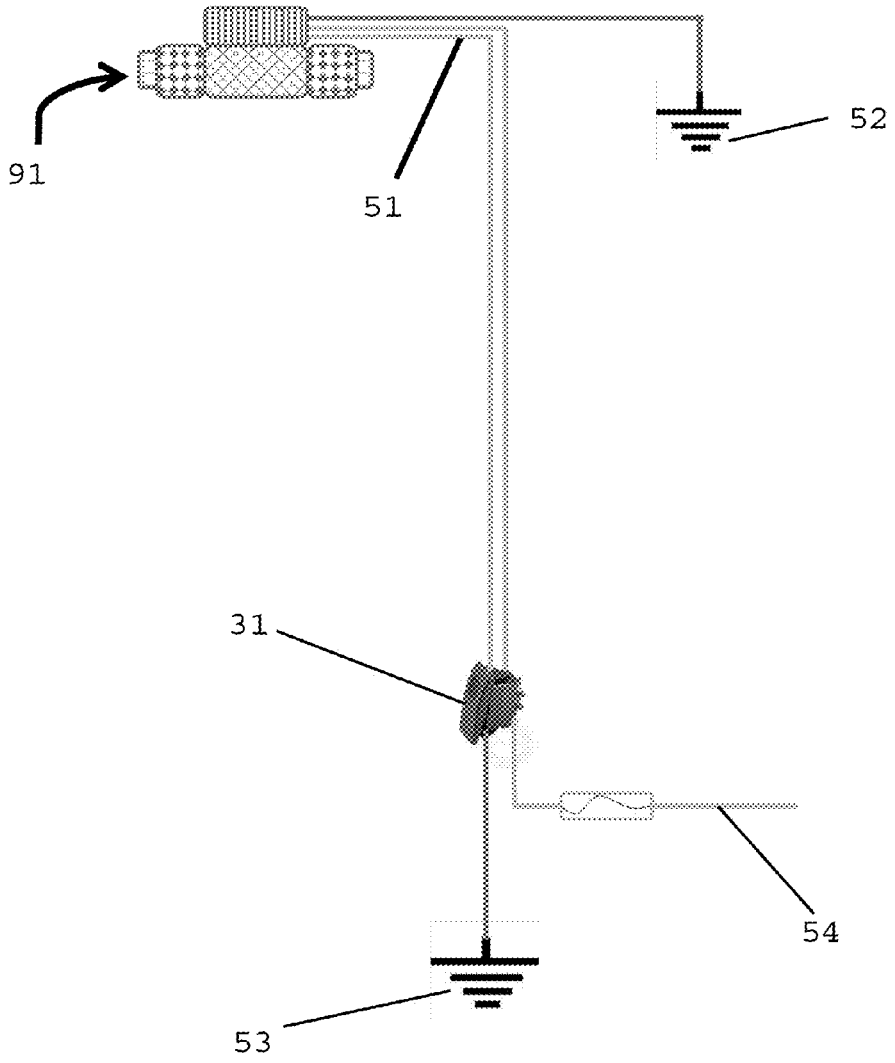
FIG. 18 is a schematic view of the electrical activation of the actuation means for the movement of the pin.

FIG. 18 is a schematic representation of the supply of electricity to the hydraulic actuation of the present invention. While hydraulics have been used on snow plows to assist with application of resistance to the forces of snow and friction experienced during plowing, the use of hydraulics has not been contemplated for uses such as that presented by the wing lock 3 for the side-mounted snow plow. Again, the hydraulic valve 91 is initiated by the electrical switch 31 and is powered by a power source such as DC Voltage 54. Again, the switch may have its own switch ground 53 also in the vehicle cabin 24. Depending on the truck, an auxiliary circuit in the Hydraulic System may be available for use. The controls and valve may vary depending on the available circuitry. A fuse must be provided to a rating suited to the coil. The surrounding components may have a weather pack connection 51. The electrical for the hydraulic actuator will be grounded by an in-cabin ground 52. In one embodiment, 25 feet of 14 gauge 2 strand wire is implemented to connect with the valve control 91. All switch options and lighting options will be available for the hydraulic actuator as well as the air actuator. See discussion above. Among the preferred hydraulic cylinders which may be implemented to meet the objectives of the present invention is the Prince™ Royal Plate 2-inch Bore Cylinder 6 Stroke cylinder.

During non-use, the wing 2 will be upright and the wing lock switch indicator light is off. The pin 12 returns to the down position through the clevis hole 153 and tongue 17 welded to the wing support arm 23 (existing). The wing 2 is securely locked until the operator drive activates the switch to the 'on' position. The light will then be illuminated. operated from a remote location such as the dashboard in the cabin 24 of the truck (see FIG. 1) with a two-way, lighted control switch 31. A switched wire (demonstrated in schematic of FIG. 11) or other means communicates between the control valve 111 and the light control switch 31 on the dash. The mechanical use of the pin mounted to an actuator allows safe and predictable implementation or storage of a snow plow wing 2.

In order to remove the preferred embodiment of the present invention from the truck, the tower arm pin 194 and 2 bracket bolts are removed. Once removed, the cylinder 10 and pin assembly may be pulled up and out of the sleeve 13. Mud flaps should be provided on the box and wing to protect against damage by the wheels.

The preferred use of the present invention will be for a side-mounted snow plow, but the novel and useful aspects of the present invention will easily be applied to dump trucks, or any other piece of equipment or machinery requiring a locking point between one or more transitions in use.

While an air, electric, or hydraulic actuator may be employed without a significant change in operation, the hydraulic actuator is preferred. The alternative air actuator may be offered as a replacement or an option and may function better or worse depending on the desired applications and climate and conditions of operation. Snow plows are frequently used in extreme weather conditions and extreme cold is known to adversely effect the reliability of some actuators. Advancements in hydraulics make them preferred in implementing the use and objectives of the present invention.

It is further intended that any other embodiments of the present invention which result from any changes in application or method of use or operation, method of manufacture, shape, size, or material which are not specified within the detailed written description or illustrations contained herein yet are considered apparent or obvious to one skilled in the art are within the scope of the present invention.

I claim:

1. A locking mechanism for a snow plow wing attached to a vehicle with a cabin, said snow plow wing attached to the vehicle by a wing frame and wing support arm, the locking mechanism further comprising:

a pin assembly, wherein the pin assembly further comprises,
- a pin sleeve,
- a pin,
  - said pin being formed and sized to fit within the pin sleeve,
- said pin assembly being affixed to the vehicle by a support tower and a base mounted on the wing frame, an actuating means,
- said actuating means being affixed to the support tower and joined with the pin assembly,
- said actuating means selectively moving the pin into or out of the pin sleeve, an electric control to trigger the actuating means,
- said electric control being installed in the cabin of the vehicle, and a pin receiving means,
- the pin receiving means comprising a tongue affixed to the wing support arm,
  - the tongue having a tongue hole,
    - the tongue hole being sized to receive the pin, the pin receiving means further comprising at least one hole in the base, the at least one hole in the base being sized to receive the pin, the pin receiving means cooperating with the pin when it is moved out of the pin sleeve.

2. The locking mechanism according to claim 1, wherein the actuating means is a hydraulic cylinder.

3. The locking mechanism according to claim 1, wherein the actuating means is electrical.

4. The locking mechanism according to claim 1, wherein the actuating means is an air cylinder.

5. The locking mechanism according to claim 1, wherein the pin is protectively sealed inside of the pin sleeve when the pin is retracted.

6. The locking mechanism according to claim 1, wherein the pin assembly further comprises at least two holes in the base.

* * * * *